US006918842B2

(12) United States Patent
Miller

(10) Patent No.: US 6,918,842 B2
(45) Date of Patent: Jul. 19, 2005

(54) DUAL PURPOSE CHILD'S BASEBALL GLOVE

(76) Inventor: Arthur Miller, 1 Commercial Ct., Plainview, NY (US) 11803

( * ) Notice: Subject to any disclaimer, the term of this patent is extended or adjusted under 35 U.S.C. 154(b) by 169 days.

(21) Appl. No.: 10/144,308

(22) Filed: May 13, 2002

(65) Prior Publication Data

US 2003/0211905 A1 Nov. 13, 2003

(51) Int. Cl.[7] ..... A63B 69/00
(52) U.S. Cl. ..... 473/424; 473/422
(58) Field of Search ..... 473/108, 138, 473/205, 393, 422–427, 450, 458, 464–466, 470, 471, 476, 478, 506, 507, 508, 510, 514, 515, 575, 576, FOR 103, 109, 197, 198, 199, 213; 273/DIG. 30, 317.8, 330–335, 412, 317.6; D21/465, 466; 2/19

(56) References Cited

U.S. PATENT DOCUMENTS 1,962,256 A * 6/1934 Nelson et al. ..... 473/214
2,142,068 A * 12/1938 Berger ..... 273/330
2,269,633 A * 1/1942 Merle ..... 473/518
2,842,366 A * 7/1958 Fant ..... 473/424
3,153,537 A * 10/1964 Lewis ..... 273/412
3,229,979 A * 1/1966 Smoak, Jr. ..... 273/330
3,469,840 A * 9/1969 Kruzel ..... 473/428
3,643,948 A * 2/1972 Coates ..... 273/330
3,731,927 A * 5/1973 Rocco, Jr. ..... 473/424
4,062,542 A * 12/1977 Manera ..... 473/576
4,753,442 A * 6/1988 Bland ..... 473/424
4,836,554 A * 6/1989 Robbins ..... 473/508
4,874,168 A * 10/1989 Wright ..... 473/458
6,042,491 A * 3/2000 Dixon, Jr. ..... 473/423
D451,559 S * 12/2001 Miles ..... D21/466

* cited by examiner

*Primary Examiner*—Mitra Aryanpour
(74) *Attorney, Agent, or Firm*—Myron Amer PC

(57) ABSTRACT

An elastic cord connects a tethered ball which is lightweight and of rubber to a tab on a child's fielding glove so when thrown it bounces back, wherein the connection to the tab is a slip knot which is readily untied and the glove then used for catching a regulation baseball.

1 Claim, 2 Drawing Sheets

DUAL PURPOSE CHILD'S BASEBALL GLOVE

The present invention relates generally to improvements enhancing the play value of a Little League, or like age group, baseball glove, in which the improvements more particularly provide the user with a learning experience of catching or learning how to catch a ball, playing alone or with a companion.

EXAMPLE OF THE PRIOR ART

With nobody available to play catch with, U.S. Pat. No. 3,153,537 for "BASEBALL GLOVE AND TETHERED BALL" issued to Lewis on Oct. 20, 1964 uses the stretching of an elastic tether cord caused by a thrown ball to induce urgency in the cord to return the ball along a path back to the thrower. This enables the user to play catch, and enjoy the experience, all alone. The tether cord attachment to the glove is of a nature, however, as exemplified by that of the '537 patent that limits the use of the glove to playing catch alone because of its permanency.

Broadly, it is an object of the present invention to overcome the foregoing and other shortcomings of the prior art.

More particularly, it is an object to provide a cooperating tether cord and glove interconnection or attachment that heretofore was undoubtedly thought to be inappropriate, but which is now provided and, with its provision, results in use of the glove without the tether cord and thus for playing catch with a companion or playmate. As will be better understood as the description proceeds, the tether cord attachment in the '537 and all other known patents was made permanent needlessly for failing to understand that the tethered ball was of necessity of rubber construction material to have a "bounce" capacity to effectuate its return to the glove and consequently lightweight. Thusly constructed, the tethered ball should not have been attached with the permanency with which it was in the prior art, and instead is now attached with such simplicity that glove use with and without the tether cord is readily possible, to thus contribute to enhanced play value of the glove by either playing catch alone or with a companion.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
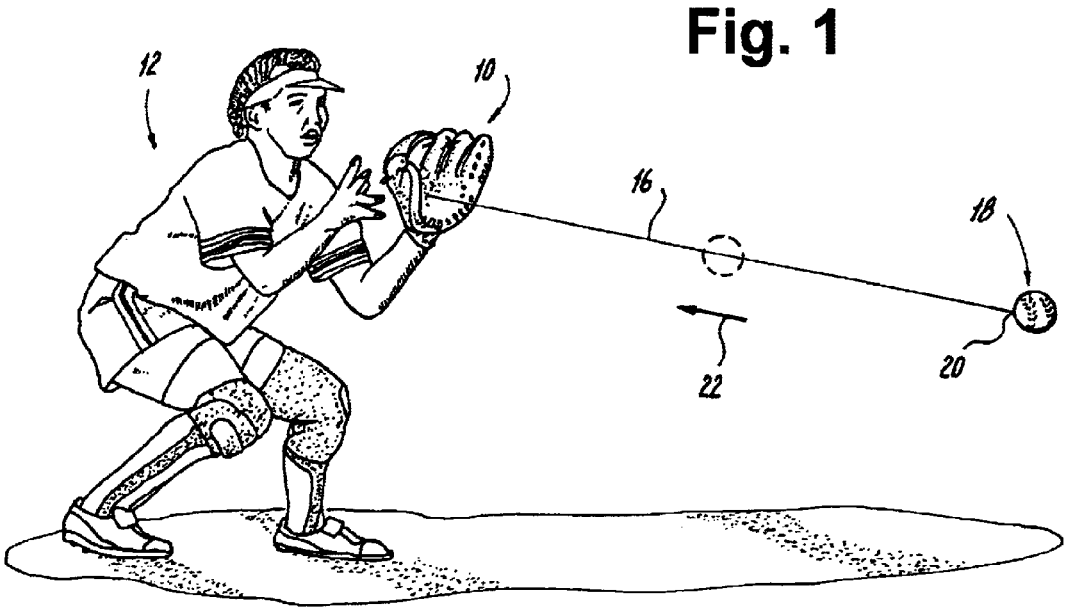
FIG. 1 is a perspective view illustrating play value derived by a user from use of the within inventive baseball glove when playing catch alone.

Playing catch for its own satisfaction, or as a learning experience for proficiency in playing competitive baseball, is a common childhood experience. Thus, FIG. 1 illustrates use of a baseball glove 10 by an aspiring baseball player 12 playing catch alone, an activity made possible by attachment of one end 14 of an elastic cord 16 which tethers a rubber ball 18 attached to the other cord end 20, such that the urgency 22 in the elastic construction material of the cord 16 returns the previously thrown ball 18 after a bounce, impact against a wall, or the like, along a return path back towards the glove 10 to be caught or to learn how to be caught by the player 12.

Figure 2:
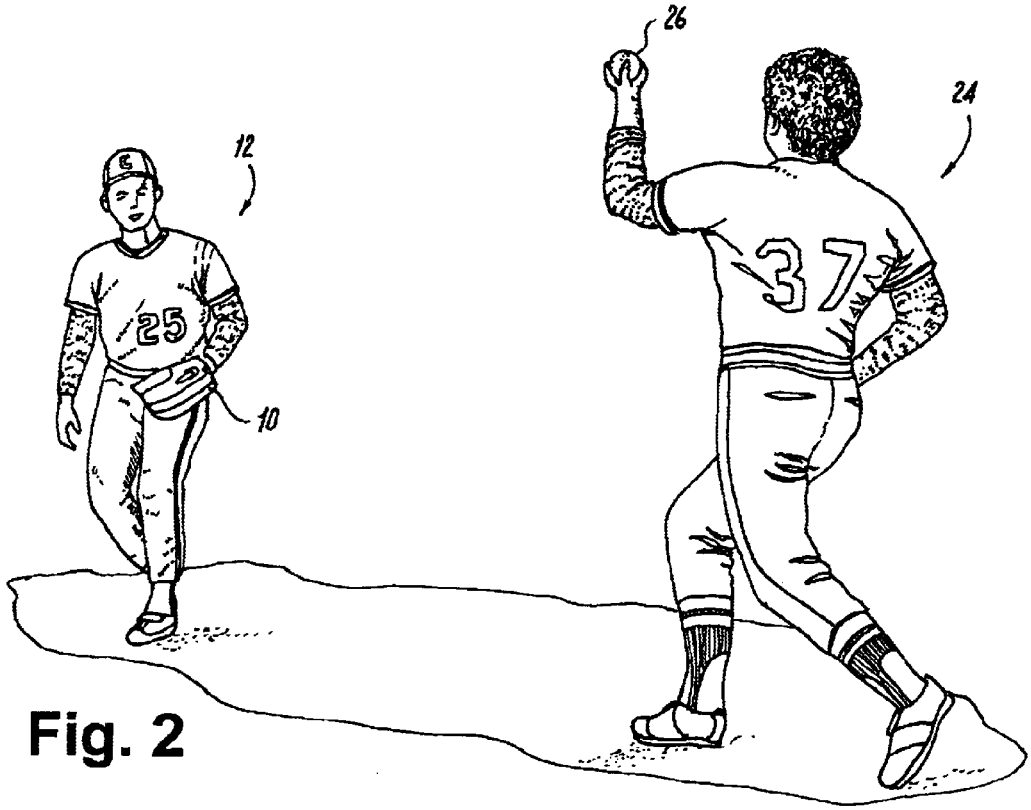
FIG. 2 is a similar view but illustrating playing catch with a playmate.

FIG. 2 illustrates a variation of the learning experience of FIG. 1 in which player 12 plays catch with a playmate 24 who, in substitution of the urgency 22, throws a ball to the player 12. This activity, of course, does not require the tether cord 16 and thus it is detached from the glove 10 and another ball 26 which need not have the bounce of a rubber ball and which is therefore preferably a regulation baseball is put into use.

Figure 3:
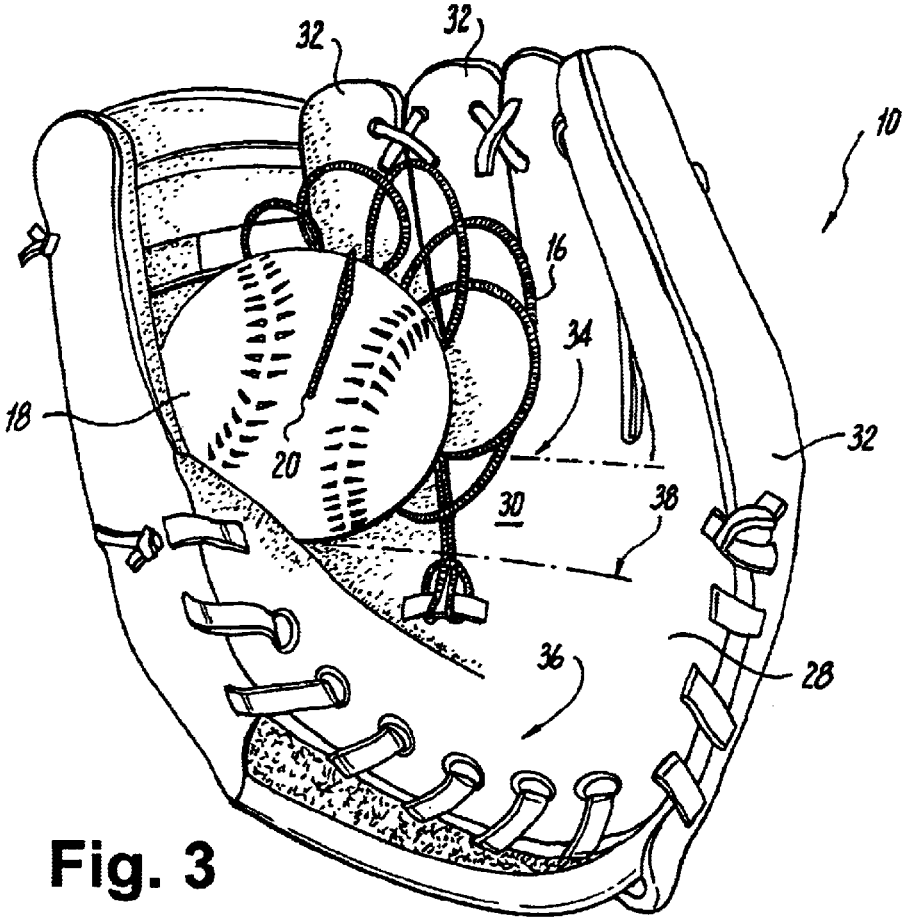
FIG. 3 is an isolated perspective view of the baseball glove as used in FIG. 1.
Figure 4:
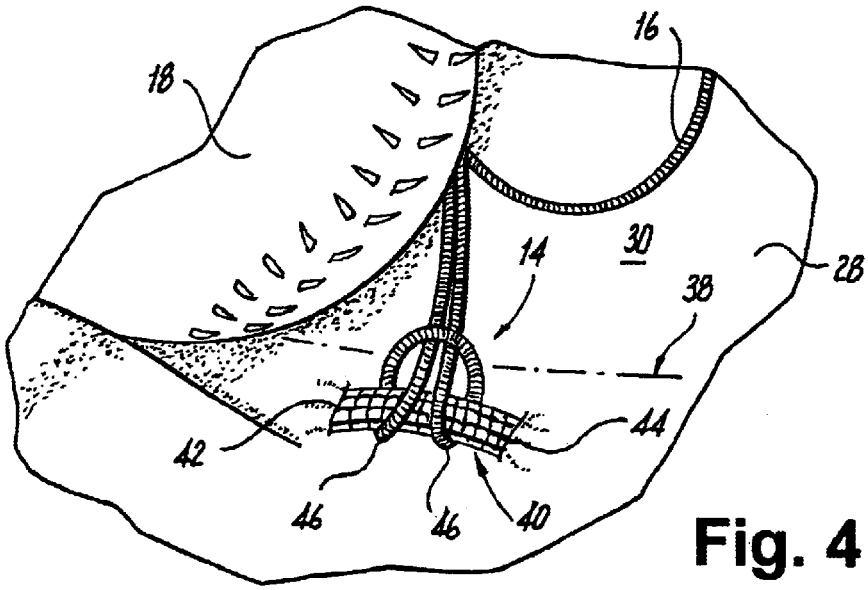
FIG. 4 is a detail view of the tab component thereof.

As best understood from FIGS. 3 and 4, to which reference should now be made, the construction of the previously generally designated glove 10 includes a body 28 of leather construction material having a ball-catching area 30 centrally thereof, which is the location best suited for catching the balls 18, 26. Finger-receiving extensions, individually and collectively designated 32, delimit or bound an upper edge 34 of the ball-catching area 30. In an area overlying the heel of the palm and often referred to as the glove heel 36, a lower edge 38 of the ball-catching area 30 is delimited or bounded by the glove heel 36. When the tether cord 16 is used, it is attached to a tab 40 having opposite ends 42 and 44 sewn, adhesively secured or otherwise affixed to the glove body 28 and, more particularly, to the heel 36 in a transverse orientation as illustrated, a position which is in a clearance position below the ball-catching area 30 and thus a position not blocking or inhibiting access into the ball-catching area 30 to a thrown ball 26 or to a returning ball 18 on the tether cord 16. The attachment of the tether cord end 20 to the ball 18 is preferably made using a slip knot 46, which provides firm securement to the glove 10 and yet is relatively easy to undo to detach the tether cord 16 preparatory to switching from FIG. 1 to FIG. 2 use of the glove.

While the construction for the different uses of the baseball glove herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A child's baseball glove having play value for participating in a ball-catching activity by a child wearing said glove playing alone or with a playmate, said baseball glove comprising a body having a ball-catching area centrally thereof for catching a baseball, finger-receiving extensions on said body delimiting an upper edge of said ball-catching area, a heel on said body delimiting a lower edge of said ball-catching area, an elastic cord having a first end and a second end each in a closed loop configuration, a rubber ball attached to said closed loop confirguration of said first end of said elastic cord, a tab with spaced apart opposite sides attached to said glove body bounding a clearance beneath said tab and having transversely oriented unattached top and bottom sides providing access to said clearance, said second closed loop configuration of said end of said elastic cord having an operative position disposed through said clearance and said first elastic cord end disposed through said closed loop configuration of said second elastic cord end to provide a slip knot for attaching said elastic cord to said glove as a tether for said ball, and an operative condition of said rubber ball of being thrown by said child in a first direction away from said baseball glove effective to stretch said elastic cord and after a bounce on a surface cause a return thereof under the urgency of said elastic cord back towards said baseball glove in an opposite direction, whereby for playing catch alone there is provided a tethered ball attached to said tab and when unattached therefrom for playing catch with a playmate there is provided ball-throwing access to said ball-catching area unrestricted by use of said tab.

* * * * *